US006467768B1

(12) United States Patent
Vary et al.

(10) Patent No.: US 6,467,768 B1
(45) Date of Patent: Oct. 22, 2002

(54) METHOD AND APPARATUS FOR CONVEYING GENERALLY FLAT ARTICLES

(75) Inventors: Sylvio Vary, Ste-Julie; André Gamba, Anjou; Marc Duval, St-Hubert; Dominique Feuiltault, St-Hilaire, all of (CA)

(73) Assignee: Machineries Feuiltault Canada Inc., Boucherville (CA)

( * ) Notice: Subject to any disclaimer, the term of this patent is extended or adjusted under 35 U.S.C. 154(b) by 111 days.

(21) Appl. No.: 09/657,656

(22) Filed: Sep. 7, 2000

(30) Foreign Application Priority Data

Sep. 7, 1999 (CA) ..... 2283531

(51) Int. Cl.[7] ..... B65H 1/02
(52) U.S. Cl. ..... 271/150; 271/149; 271/3.12
(58) Field of Search ..... 271/150, 149, 271/3.12, 69, 179; 198/657

(56) References Cited

U.S. PATENT DOCUMENTS 3,240,488 A * 3/1966 Lyman ..... 271/62
3,598,399 A * 8/1971 Cottrell ..... 271/62 B
3,618,792 A * 11/1971 Paxton ..... 214/8.5 F
3,881,718 A * 5/1975 Fernandez-Rana et al. ... 271/10
4,039,181 A * 8/1977 Prewer ..... 271/10
4,183,517 A * 1/1980 Hageman et al. ..... 271/150
4,295,645 A * 10/1981 Nahar et al. ..... 271/34
4,366,955 A * 1/1983 Pessina et al. ..... 271/7
4,750,728 A * 6/1988 Keller ..... 271/161
4,973,038 A * 11/1990 Curley et al. ..... 271/146
5,154,408 A * 10/1992 Stephan et al. ..... 271/121
5,167,408 A * 12/1992 Golicz ..... 271/149
5,244,199 A * 9/1993 Wood ..... 271/150
5,282,613 A * 2/1994 Standerfer et al. ..... 271/202
5,284,335 A * 2/1994 Golicz ..... 271/149
5,374,050 A * 12/1994 Prim ..... 271/221
6,017,028 A * 1/2000 St. John et al. ..... 271/3.01
6,017,029 A * 1/2000 Bates et al. ..... 271/3.12
6,220,590 B1 * 4/2001 Bates et al. ..... 271/3.01

* cited by examiner

*Primary Examiner*—Christopher P. Ellis
*Assistant Examiner*—Rashmi Sharma
(74) *Attorney, Agent, or Firm*—Goudreau Gage Dubuc

(57) ABSTRACT

The method and apparatus for delivering generally flat articles one by one make use of first and second conveyors. The first conveyor has a top article-supporting surface operated at a first linear speed in a forward direction. In operation, a stack of generally flat articles lies on one side on this top article-supporting surface longitudinally of the first conveyor. The second conveyor is installed in series with the first conveyor, operates at a second linear speed higher than the first linear speed in the forward direction, slopes upwardly in the forward direction, and includes a plurality of generally parallel, rotative longitudinal screws having respective threads structured to engage a lower edge of the generally flat articles. According to the method, the generally flat articles are jogged and thereby separated from each other through slipping of the lower edges of these articles on the successive ridges and grooves of the threads of the rotative longitudinal screws. In operation, a rate of processing of the generally flat articles supplied from a discharge end of the second conveyor to a downstream article-processing equipment is measured, and the first and second linear speeds are adjusted in relation to this measured rate of processing. Preferably, article detecting proximity sensors are mounted at the discharge end of the second conveyor, and the first and second linear speeds are adjusted also in relation to signals from these article-detecting proximity sensors.

16 Claims, 6 Drawing Sheets

METHOD AND APPARATUS FOR CONVEYING GENERALLY FLAT ARTICLES

BACKGROUND OF THE INVENTION

1. Field of the Invention

The present invention relates to a method and apparatus for delivering flat articles, in particular but not exclusively printed sheet signatures hereinafter referred to as "signatures".

2. Brief Description of the Prior Art

Traditionally, loading of bindery line systems, generally comprising a hopper and a rotary feeding drum, is manually accomplished by an attendant. When the signatures are coming from a folding operation, they are tightly compressed to form a bundle and some of them frequently adhere to each other depending on various printing and storage conditions. It is well known in the art that the reliability and through-output of the bindery line is mainly lying on the ability to properly operate signature separation, as traditionally executed by the attendant, so that the feeding system will continuously succeed at transferring one signature at a time to the gathering conveyer, thus avoiding costly interruptions of the bindery line. The manual operation of separation is usually carried-out by the attendant by taking a pile of signatures and bending the pile back and forth a few times. Additionally, some tapping of the edges of the pile on a generally horizontal flat surface may be performed. More recently, automatic hopper loaders have been provided by the industry to accomplish the task of loading feeding systems, but the main challenge still resides in performing proper separation of the signatures prior to feeding.

While in some situations currently available loaders provide an appropriate level of separation of the incoming tightly stacked on-edge signatures from bundles, there are still many instances where the conditions of the incoming signatures exceed the capacity of the automatic loader to operate proper separation. These conditions relate to the properties of the paper web used to produce the signatures, the thickness of the signatures, the type of ink and the density and intensity of the printed indicia. Indeed, when heavy gauge paper with a good absorption rate is bearing light printed text and is folded to form thick signatures, sticking of folded and stacked signatures together is not likely to happen, and automatic loading can be reliably and effectively accomplished with currently available equipment. However, most of the high volume and high speed bindery productions of the present days involve large and thin signatures obtained from light weight glossy paper web printed with colourful heavy indicia. Such conditions are found in the production of magazines, catalogues, and the like and are generally faced on the stitch bindery lines.

In spite of numerous attempts to produce signature bundle loaders providing an appropriate level of separation of the tightly stacked incoming signatures, no currently available equipment can load a stitch bindery line feeding system with a sufficient level of reliability, given the adverse conditions generally encountered during this operation.

Actually, most bundle loaders pay little attention to separation and merely rely on passing the signatures from a first conveyor to a second conveyor sloped upwardly with respect to the first one and driven at a higher speed, thereby making the incoming on-edge signatures to space apart at their upper end and gradually adopt the form of an imbricated or shingled stream. Air jets or physical members are sometimes disposed over the upper edge of the signatures to penetrate between the signatures approaching the second conveyer and force them to separate and urge their forward surface toward the surface of the second conveyor. U.S. Pat. No. 5,374,050 (1994) issued to Prime-Hall Enterprises, U.S. Pat. No. 5,282,613 (1994) granted to R. R. Donnelly & Sons Company and U.S. Pat. No. 4,973,038 (1990) owned by AM International Inc. present examples of that technique which converts stacked onedge signatures to a forward shingle stream, with the side edges of the signatures 1being inclined forwardly and upwardly.

This technique is not much different than the one used in the feeding mechanisms themselves and therefore does not provide a sufficient increase in reliability to hold down times to a reasonable level when used under the adverse conditions generally encountered on stitching lines. For that reason, certain manufacturers such as Harris-Intertype Corp. (U.S. Pat. No. 3,881,718) introduce a transfer of the shingled stream to a third conveyor running at a higher speed than the second one to create an additional relative displacement of the signatures under the shear stress, thus producing a thinner shingle and improving separation. The Harris apparatus also has its third conveyer surface disposed slightly lower than the one of the second conveyor which adds a vertical separating action to the horizontal action provided by the speed change. However, it can be demonstrated that the speed change method as well as vertical stepping become less effective when the signature major faces become substantially horizontal. This is simply due to the fact that the weight of the upstream signatures creates more friction between the layers at such angles, which tends to oppose to the shear stress and keep the signatures attached, while in a more vertical fashion, the weight of the top signatures tends to make them slip downwardly when the lower ones are upwardly accelerated. In a similar manner, a vertical stepping movement will make more effective use of the weight of the signatures for separation when the faces of the signatures adopt a substantially vertical orientation.

Taking into account the fact that on most stitching lines, signatures must be delivered standing on their backbone to form a stack in the hopper of the feeding system, the prior art apparatuses also feature mechanisms to reverse the shingled signature stream or create a shingled stream such that the lagging portion of a downstream signature rests on the surface of the following (upstream) one. This is required when shingled signatures are to be placed substantially vertically in the hopper, since the downstream signatures must not be retained by following signatures in order to fall freely into the hopper. A certain number of mechanisms have been proposed to that effect in the past, and only contribute to add more complexity and risks of malfunction.

Very few examples of apparatuses performing signature separation in a substantially vertical fashion are found in the prior art. A typical approach is to try to replicate the pile bending operation manually carried-out by the attendant. As shown in U.S. Pat. No. 5,244,199 (1993) assigned to St-Denis Manufacturing, U.S. Pat. No. 4,750,728 (1988) granted to Ferag A G and U.S. Pat. No. 4,183,517 (1980) issued to Harris Corporation, the generally upwardly oriented edge standing signatures are passed trough one or more conveyor sections having convergent wall members spaced by an average distance shorter than the width of the signatures. This technique generally requires side conveyors for proper traction of the signatures. This implies more complex mechanisms, additional costs and a wider apparatus while machine spacing is a critical factor to provide enough room for attending and maintenance. Moreover, the number of bending cycles is limited to one or two, with low amplitude and in only one direction, which is a poor substitution for the manually performed operation.

As will be shown in the foregoing description of the present invention, complex mechanisms as described above can be avoided with increased reliability and cost reduction while also avoiding the formation of the signatures into a thin shingle. Furthermore, significant space savings can be achieved by maintaining signatures in a substantially vertical fashion and avoiding transportation over long belt runs in thin shingle form.

The above review of the prior art clearly shows that no reasonably reliable and practical solution to the problem of automatically handling a bundle of signatures to load the feeding system of a stitch binding machine or a comparable piece of equipment has been provided until now.

SUMMARY OF THE INVENTION

In accordance with the present invention, there is provided an apparatus for delivering generally flat articles one by one, comprising first and second conveyors. The first conveyor has a top article-supporting surface operated at a first linear speed in a forward direction, wherein, in operation, a stack of generally flat articles lies on one side on the top article-supporting surface longitudinally of the first conveyor. The second second conveyor is installed in series With the first conveyor, operated at a second linear speed higher than the first linear speed in the forward direction, sloping upwardly in the forward direction, and including a plurality of generally parallel, rotative longitudinal screws having respective threads structured to engage a lower edge of the generally flat articles.

The present invention also relates to a method of delivering generally flat articles one by one, comprising:

lying on one side a stack of generally flat articles on a top article-supporting surface of a first conveyor longitudinally of the first conveyor;

driving the top article-supporting surface of the first conveyor at a first linear speed in a forward direction;

transferring the generally flat articles of the stack from the top article-supporting surface of the first conveyor to a second conveyor installed in series with the first conveyor and including a plurality of generally parallel, rotative longitudinal screws having respective threads each defining a succession of ridges and grooves, the transfer of generally flat articles comprising engaging lower edges of the generally flat articles with the threads of the rotative longitudinal screws;

sloping the second conveyor upwardly in the forward direction;

operating the second conveyor at a second linear speed higher than the first linear speed in the forward direction through rotation of the longitudinal screws; and jogging the generally flat articles by slipping the lower edges of the generally flat articles on the successive ridges and grooves of the threads of the rotative longitudinal screws.

In the above apparatus and method, the jogging movement of the generally flat articles on the successive ridges and grooves of the threads of the rotative longitudinal screws ensure reliable separation of the generally flat articles.

Still according to the present invention, there is provided a method of controlling a conveyor system provided with a discharge end and a top article-supporting surface mobile at a variable linear speed toward a downstream article-processing equipment, wherein, in operation, a stack of generally flat articles is placed on one side on the top article-supporting surface longitudinally of the conveyor system to supply to the equipment generally flat articles one by one from the discharge end. This control method comprises measuring a rate of processing, by the article-processing equipment, of the generally flat articles supplied from the discharge end of the conveyor system, and adjusting the linear speed of the top article-supporting surface in relation to the measured rate of processing.

In accordance with preferred embodiments of the above control method:

the processing rate measurement comprises measuring a speed of rotation of a rotative member of the downstream article-processing equipment; and the conveyor system further comprises article-detecting proximity sensors mounted at the discharge end, and the linear speed adjustment comprises adjusting the linear speed of the top article-supporting surface also in relation to signals from the article-detecting proximity sensors.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

The preferred embodiment of the method and flat product delivering apparatus of the present invention will now be described in detail referring to the appended drawings.

Although this preferred embodiment will be described with reference to the handling of signatures in a bindery process, it should be kept in mind that the method and apparatus according to the present invention can be used in a variety of other applications dealing with generally flat articles, in particular but not exclusively in sheet form.

Figure 1:
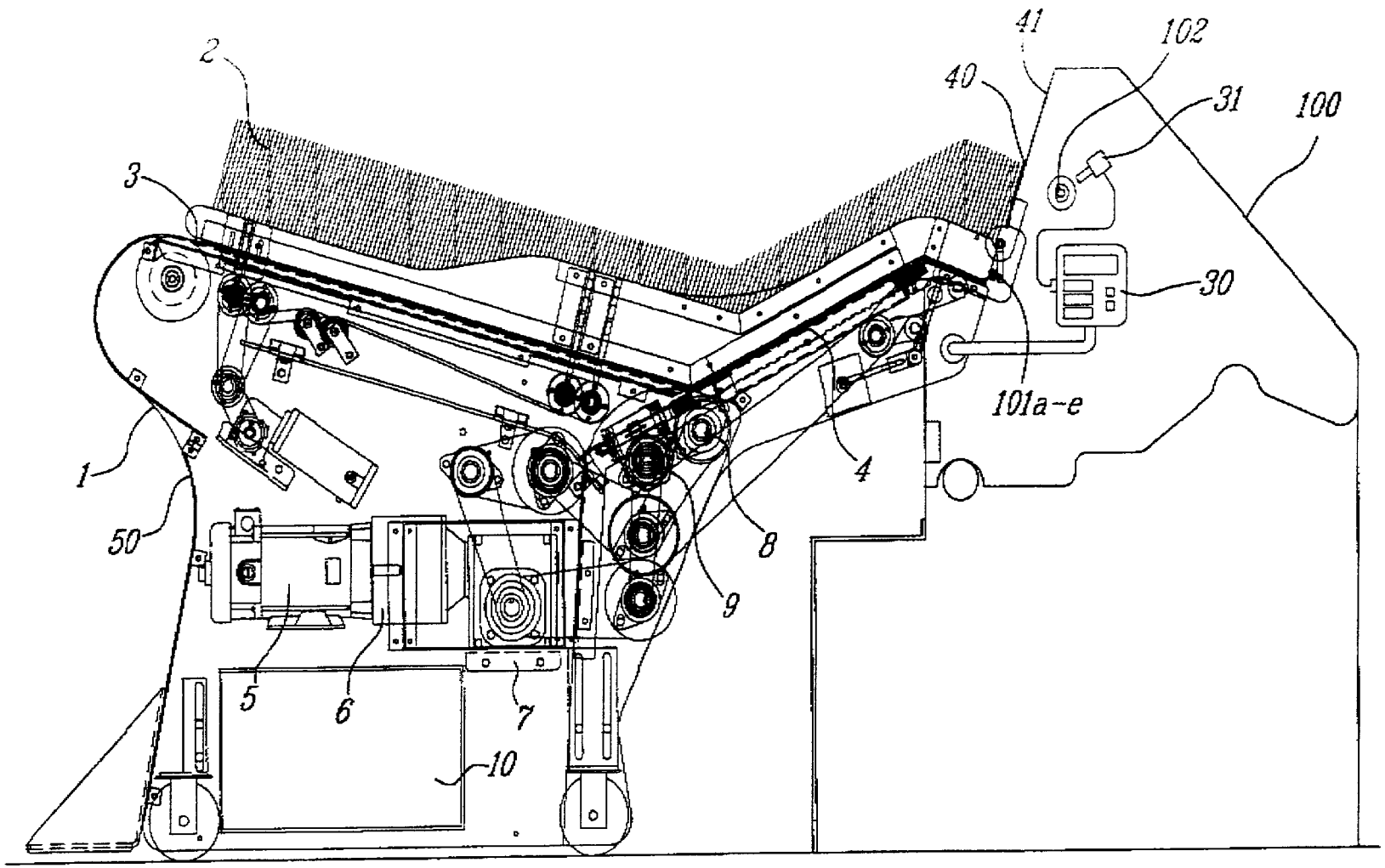
FIG. 1 is a side elevation view of the preferred embodiment of the apparatus according to the present invention, cooperating with a gatherer feeder.

Referring to FIG. 1, there is provided an apparatus generally identified by numeral 1, which is designed to deliver incoming bundled, stacked signatures 2 standing upright on their backbone (lower edge) to a vertical hopper 40 co-operating with the feeding system of a bindery line, preferably a stitch bindery line. As will be described in the following description, the apparatus 1 conducts a signature delivering method incorporating a highly reliable separation of the stacked signatures.

The preferred delivering method with highly reliable separation basically comprises:

a) placing and transporting the signatures on a downwardly and forwardly sloped feed conveyor (optionally, this feed conveyor slopes downwardly in the forward direction), standing on their backbone with their faces substantially normal to the plane of the conveyor;

b) transferring the signatures to an upwardly and forwardly sloped screw conveyor running at a higher linear speed with respect to the feed conveyor, so that the signatures are accelerated at their lower edge (backbone) and tend to mesh with the threads of the screws to slightly space apart and form a generally vertically oriented pile;

c) vertically jogging the signatures through a slipping action, through successive passages from ridges to grooves of the screws of the screw conveyor;

d) dragging the lower edge (backbone) of the signatures on a row of substantially vertical needles to provide a gating action which retains the upstream signatures when the leading signature being pulled by the feeding system of the downstream signature-processing equipment.

Preferably, in using this method, an upwardly oriented air flow is directed toward the backbones of the signatures at the pick-up line of the screw conveyor to help performing separation of these signatures.

The preferred method also contemplates variation of the speed of the signatures while they are riding on the screw conveyor as an ultimate means for further increasing the reliability of signature separation for optimal yield of the feeding action. This is accomplished by varying the pitch of the thread over the length of the screws, either in a continuous manner or in successive cycles of acceleration/deceleration. Those repeated cycles of acceleration/deceleration can be provided by the screw conveyor through proper design and machining of the threads while maintaining a constant angular speed (RPM) drive. The result is equivalent to successive passages of the signatures on several belt conveyors running at different speeds. A high performance separation means is thereby provided, adjacent signatures being forced to adopt variable relative horizontal and vertical positions along the path, causing sustained shear and tensile stress in the bundle, thus separation of the signatures.

Figure 4A:
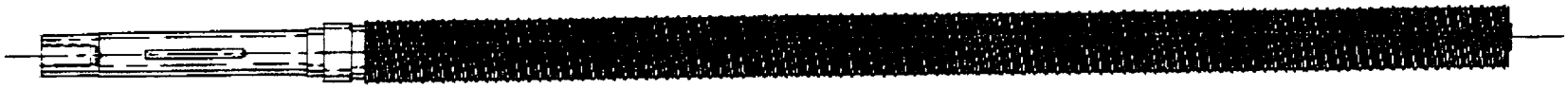
FIG. 4*a* is a first side elevation view of one of the longitudinal screws of a screw conveyor.
Figure 4B:
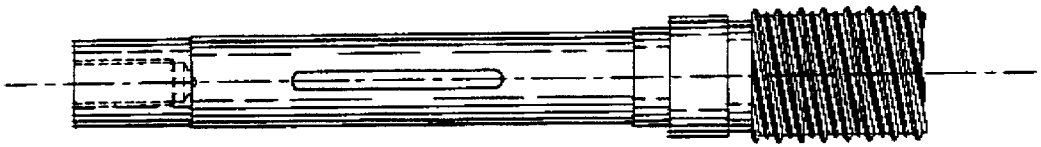
FIG. 4*b* is a second side elevation view of a distal end section of the longitudinal screw of FIG. 4*a;*
Figure 4D:
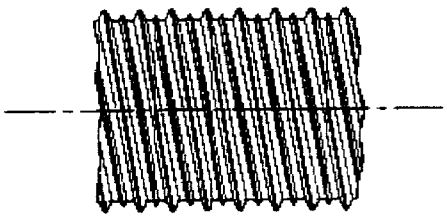
FIG. 4*d* is a fourth side elevation view of a section of the longitudinal screw of FIG. 4*a* showing a dual thread.
Figure 4C:
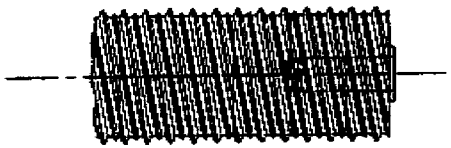
FIG. 4*c* is a third side elevation view of a proximal end section of the longitudinal screw of FIG. 4*a;*

Furthermore, in the preferred embodiment the global feed rate is automatically adjusted according to the speed of the downstream equipment being fed by the apparatus 1, and the conveying screws are provided with dual threads as shown in FIG. 4*d,* for adaptability to a wide range of signature thicknesses.

Figure 2:
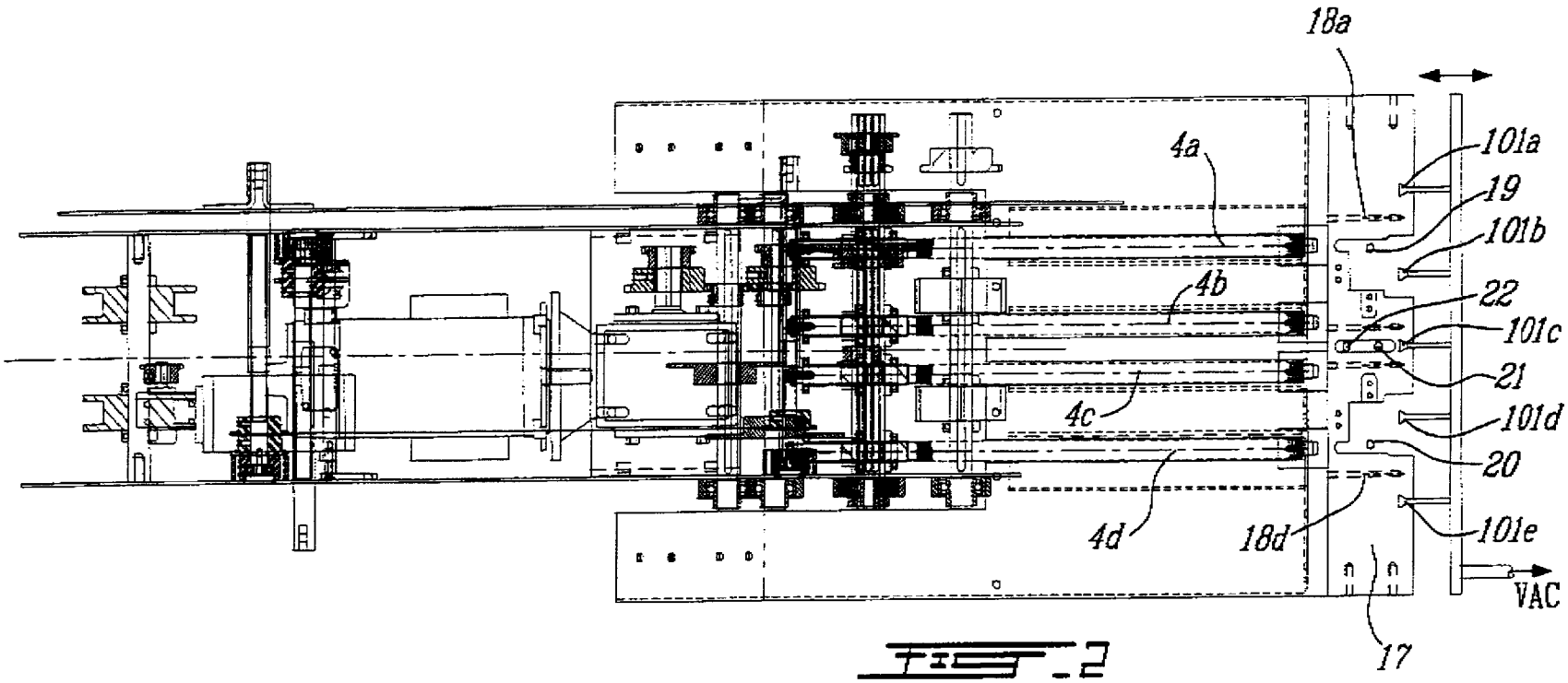
FIG. 2 is a top plan view of the apparatus of FIG. 1 cooperating with a gatherer feeder.

FIGS. 1 and 2 show a global view of the preferred embodiment of the apparatus for carrying out the above recited method. The apparatus, generally identified by reference numeral 1 in FIG. 1, is supported on a mobile frame 50. A bundle of signatures 2 (stack of generally flat articles) is placed on the side on an upstream portion of a feed conveyor 3 and the straps and end plates of the downstream bundle are removed to release the signatures, retained between the new bundle and the downstream signatures. The free signatures are conveyed on the downwardly eloped feed conveyor 3 preferably made of flat steel chains or any other type of suitable belt means, up to a screw conveyor consisting of four parallel screws 4*a–d* sloping upwardly. Conveyors 3 and 4 are driven by a variable speed motor 5 through an electrical clutch 6, a speed reducer 7, and a conventional chain and sprocket transmission system 77 finally coupled to drive shafts 8 and 9. The shaft 8 drives a sprocket (not shown) driving in turn chain conveyor 3, and shaft 9 drives four 90° gear boxes 11*a–d* connected to the lower end of the screws 4*a–d*. The system provides a fixed ratio from about 1.15:1 to 1.2:1 between the linear speed of the screw conveyor 4 and the linear speed of the chain conveyor 3. A motorised driving system of the above type is well known to those of ordinary skill in the art and. accordingly, will not be further described in the subject patent application.

The motor 5 and clutch 6 are controlled by a controller 10, according to the information provided by proximity sensors 21 and 22 (FIG. 3), a speed encoder 31 (FIG. 1) and a control panel 30 (FIG. 1).

Figure 3:
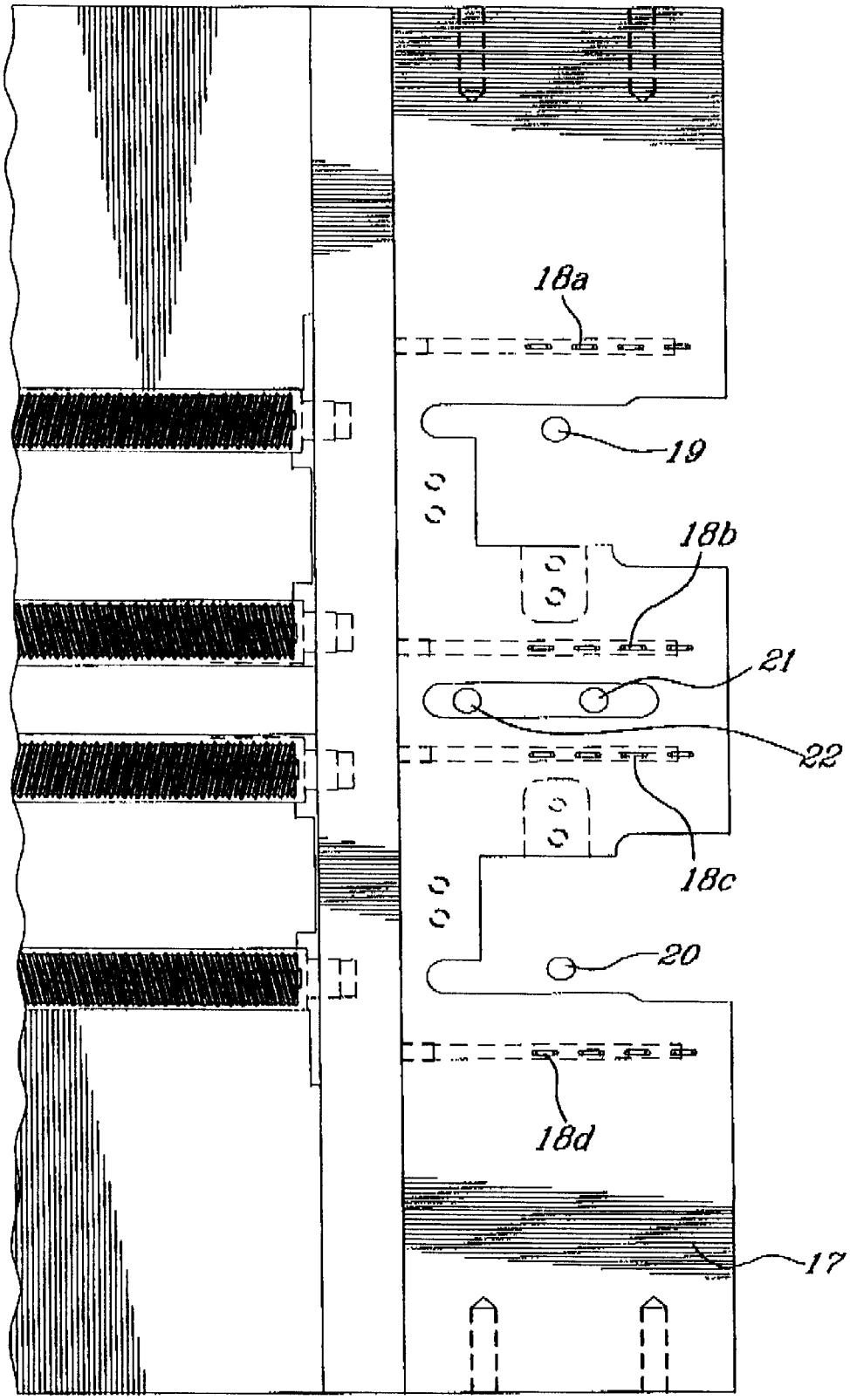
FIG. 3 is an enlarged top plan view of a portion of the apparatus of FIG. 1, showing the relative position of needles and proximity sensors.

As shown in FIG. 3, the proximity sensor 22 is located downstream the proximity sensor 21 at the same vertical level of a flat plate 17 between the distal end of the screw conveyor 4 and the downstream article-processing equipment 100. As a non limitative example, the speed encoder 31 detects rotation of a rotary member such as 102 (FIG. 1) of the downstream article-processing equipment 100. The control panel 30 is used to turn the apparatus 1 on and off and to enter operational parameters such as the thickness of the signatures.

Automatic adjustment of the signature feed rate is accomplished as follows: the speed encoder 31 provides the controller 10 with the number of signatures being processed per minute. The controller 10 calculates a linear feed rate for a reference average signature thickness and sets the speed of motor 5 accordingly while monitoring the signals from the proximity sensors 21 and 22. Fine speed adjustments are then made so that the leading signature is always comprised between the two proximity sensors, i.e. sensor 22 sees no signature while sensor 21 sees one all the time. After a few iterations, Thai appropriate speed is found and maintained through start and stop cycles of clutch 6 (or, alternatively, through appropriate control of a direct drive dc servomotor (not shown and replacing the motor 5 and clutch 6 arrangement) for smoother operation). More specifically, the clutch 6 stops the conveyors 3 and 4 when the signatures reach sensor 22 and starts them when sensor 21 senses no presence. In the application represented in FIG. 1, the accurate and soft operation thereby provided ensures that no excessive pressure is applied on the signatures against the wall 41 of hopper 40, which could prevent suckers 10*a–e* and feeding mechanism 100 from successfully pulling the leading signature. The suction cups 101*a–e* repeatedly pick-up the lower portion of the leading signature at a position comprised between the two proximity sensors, representing a variation of a few millimeters.

It shall be noted that the aforementioned assembly provides continuous transfer with no gap between conveyors 3 and 4, so that the signatures 2 are smoothly transferred from conveyor 3 to conveyor 4. However, as indicated hereinabove, screw conveyor 4 is driven at a linear speed considerably higher than the linear speed of the chain conveyor 3 for a given rotation speed of the motor 5, and creates a change in the signature path of about 45° upwardly. The signatures 2 are therefore transferred from feed conveyor 3 to screw conveyor 4 by being suddenly accelerated at their lower edge and forced to form an upward slope. These actions provide a first means of separation of the signatures by way of axial pulling and vertical shearing of adjacent signatures, mainly at the interface of the two conveyors.

Also, the signatures are not positively transported by the screw conveyor 4 due to the rising of the slope and to the high difference in linear speed with respect to conveyor 3, such that some slipping occurs making the signatures to travel along the path of the screw threads. The resulting zig-zag like reciprocating vertical travel across ridges and grooves creates numerous cycles of shearing action between adjacent signatures all along the screw path. Experience showed that such a jogging carried out at 10 to 20 strokes per second with a vertical amplitude of about 3 millimeters was much more effective at separating signatures than vibration performed at higher frequency and lower amplitude. That shearing action combined with the axial separation due to the tendency of the signatures to align with the grooves and match the thread pitch provide a second means of separation. It shall be pointed out that the screws preferably comprise a dual thread as illustrated in FIG. 4*d,* for optimal performance with thinner as well as thicker signatures.

Furthermore, it is contemplated to vary the pitch of the screw threads to create a definite number of axial dilatation and compression cycles to further improve separation reliability. Consequently, it can be observed in operation that the top of the signature bundle gradually matches the screw slope without irregularities when approaching the forward end of the screw conveyor 4.

Just a word to mention that a short belt conveyor section (not shown) may be provided to connect the distal end of the screw conveyor to the hereinafter described pair of needles 19 and 20 (gating system).

As shown in FIGS. 2 and 3, a pair of spring biased needles 19 and 20 are located next to the pick-up line between proximity sensors 21 and 22 and projects beyond the top surface of flat bottom plates 17 by a few millimeters to act as a soft stop on the lower edge of the leading signature and provide a gating action. When the suction cups 101*a–e* pull the leading signature forwardly, the needles bend forwardly and return to their original position under spring action, stopping the next signatures as soon as they are cleared by the lower edge of the leading signature. That action provides an ultimate means of separating the signatures to ensure one-at-a-time feeding. It is indeed of primary importance for proper operation of the bindery line that the pulled signature separates easily from the stack in hopper 40 to be placed on the saddle conveyor one at a time and avoid costly interruptions of the line upon miss feed. The apparatus according to this preferred embodiment can perform that task at high signature feed rates up to about 20 000 signatures per hour.

Optionally, air jets fed through series of holes 18*a–d* provided in the flat plates 17 can be directed toward the lower edge of the signatures approaching the pick-up line. Air penetrates between adjacent signatures and builds up a pressure that in turn creates an axial separation force thereby increasing their susceptibility to vertical slipping.

Figure 5:
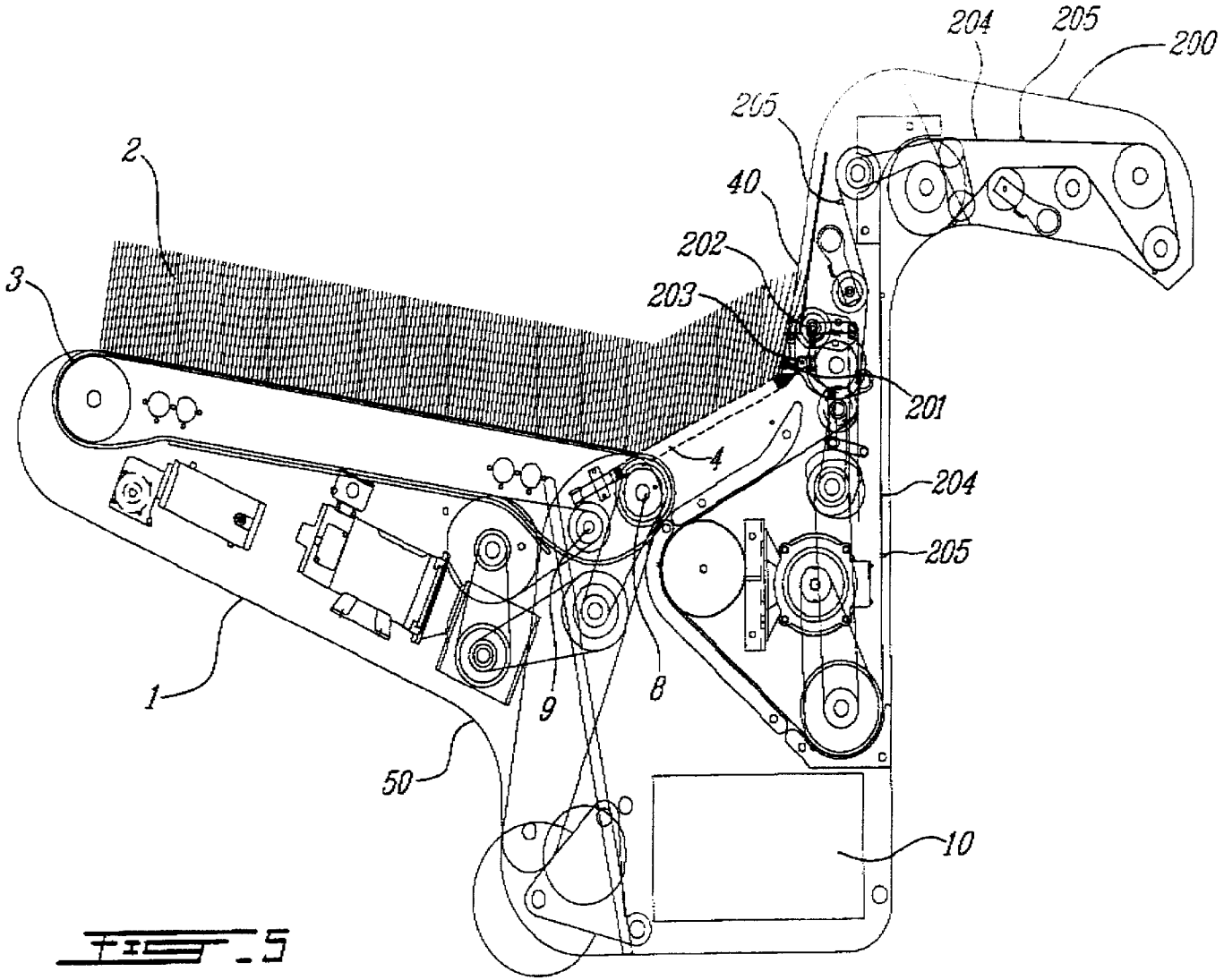
FIG. 5 is a side elevation view of the preferred embodiment of the apparatus of the present invention, provided with an optional one-at-a-time signature transporting/feeding attachment.
Figure 6:
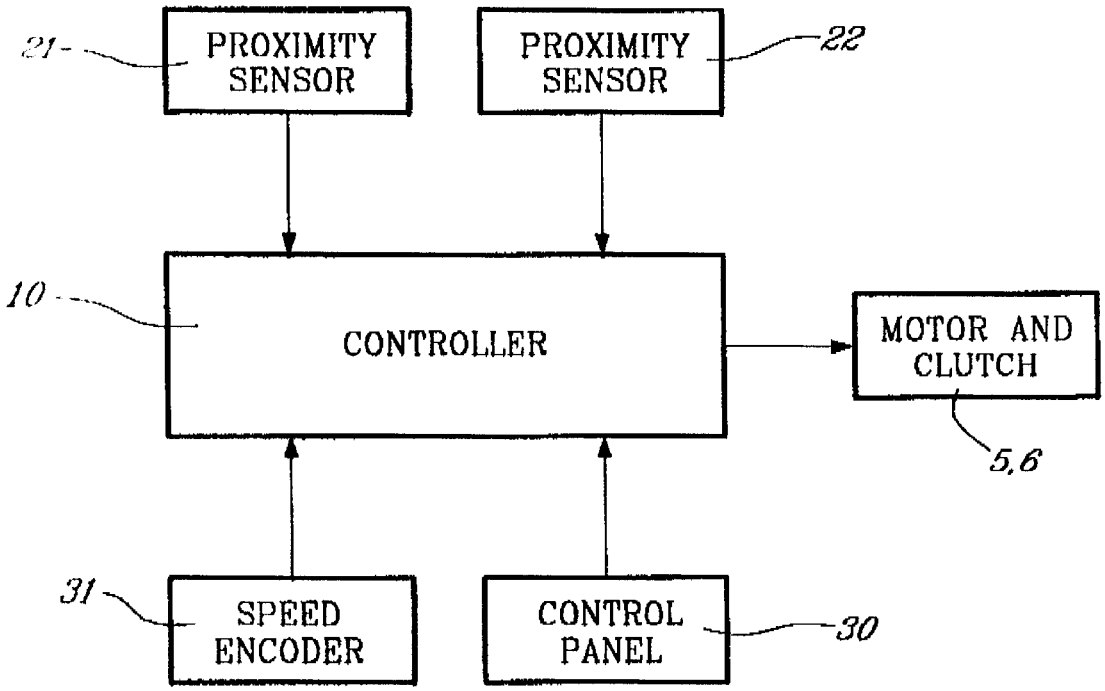
FIG. 6 is a schematic block diagram of a controller circuit for adjusting the linear speed of feed and screw conveyors of the apparatus of FIGS. 1 and 5.

An apparatus 1 with a one-at-a-time signature transporting/feeding attachment 200 as illustrated in FIG. 5 can also be provided. This attachment comprises a set of suction cups such as 201 like a gatherer feeder which pulls the lower portion of the leading signature from the hopper 40 to bring it in contact with a first static roller 202. A second powered roller 203 then engages the signature and feeds it to a belt conveyor 204 provided with rows of cleats such as 205 contacting the backbone to positively transport the signature. The signatures are thereby loaded one behind the other and transported over successive downward and upward vertical paths to perform operations such as ink jet printing on either face thereof. Signatures finish their travel on the top of the apparatus and are dropped one by one in a vertical or horizontal hopper to feed an equipment such as a drum gatherer feeder for a Stitching or binding line.

The present invention presents, amongst others, the following advantages:

- separation of the generally flat articles potentially adhering to each other is accomplished with a high level of reliability;
- the method and apparatus for delivering generally flat articles satisfy high speed operation requirements;
- the method and apparatus for delivering generally flat articles to a hopper are simple and economical in construction while featuring a high overall reliability;
- the method and apparatus for delivering generally flat articles have the flexibility to comply with operating conditions related to a very wide range of signature types while requiring minimal and easy setup, these conditions including paper gauge and finish, type of ink, signature size, thickness and stiffness, and density and intensity of the printed indicia;
- the method and apparatus for delivering generally flat articles perform separation operations on the generally flat articles while their faces form an angle of less than 45 degrees with respect to a vertical plane, so that the most of their weight is supported by their backbone which contributes to the separation process;
- the method and apparatus for delivering generally flat articles avoid transportation of signatures in flat shingle form, thus providing significant space savings;
- the signature feed rate is automatically adjusted to the speed of the downstream signature-processing equipment;

Although the present invention has been described by means of preferred embodiments thereof, it is contemplated that various modifications may be made thereto without departing from the spirit and scope of the present invention. Accordingly, it is intended that the embodiments described be considered only as illustrative of the present invention and that the scope thereof should not be limited thereto but be determined by reference to the claims hereinafter provided and their equivalents.

What is claimed is:

1. An apparatus for delivering generally flat articles one by one, comprising;

a first conveyor having a top article-supporting surface operated at a first linear speed in a forward direction, wherein, in operation, a stack of said generally flat articles lies on one side on the top article-supporting surface longitudinally of the first conveyor; and a second conveyor installed in series with the first conveyor, operated at a second linear speed higher than the first linear speed in the forward direction, sloping upwardly in the forward direction, and including a plurality of generally parallel, rotative longitudinal screws having respective threads structured to engage a lower edge of the generally flat articles.

2. A flat article delivering apparatus as defined in claim 1, wherein the first conveyor slopes downwardly in the forward direction.

3. A flat article delivering apparatus as recited in claim 1, further comprising a one-by-one article-supply gate downstream a discharge end of the second conveyor opposite to the first conveyor, said gate stopping the generally flat articles to enable a feeding system of a downstream article-processing equipment to pick up said articles one by one.

4. A flat article delivering apparatus as recited in claim 1, wherein the top article-supporting surface of the first conveyor comprises laterally adjacent and parallel flat chains.

5. A flat article delivering apparatus as recited in claim 1, further comprising a variable-speed motorized mechanism in drive engagement with both the top article-supporting surface of the first conveyor and the rotative longitudinal screws of the second conveyor.

6. A flat article delivering apparatus as recited in claim 1, further comprising a generator of upwardly oriented air jets directed toward the lower edges of the generally flat articles downstream a discharge end of the second conveyor opposite to the first conveyor.

7. A flat article delivering apparatus as recited in claim 1, wherein the thread of each rotative longitudinal screw of the second conveyor has a pitch varying along the length of said longitudinal screw.

8. A flat article delivering apparatus as recited in claim 7, wherein the thread of each rotative longitudinal screw of the second conveyor has a continuously varying pitch.

9. A flat article delivering apparatus as recited in claim 7, wherein the thread of each rotative longitudinal screw has a pitch varying in accordance with successive cycles of acceleration/deceleration.

10. A flat article delivering apparatus as recited in claim 1, wherein the rotative longitudinal screws of the second conveyor each comprise a dual thread for adaptability to a wide range of article thickness.

11. A flat article delivering apparatus as recited in claim 1, wherein the first and second conveyors define an angle of about 45°.

12. A flat article delivering apparatus as recited in claim 3, wherein said gate comprises a plurality of spring-biased needles located next to an article pick-up line at the discharge end of the second conveyor, said spring-biased needles forming a signature soft stop providing a gating action.

13. A flat article delivering apparatus as recited in claim 1, wherein said generally flat articles are supplied one by one to a downstream article-processing equipment from a discharge end of the second conveyor, said flat article delivering apparatus further comprising:

a detector of a rate of processing, by said equipment, of the generally flat articles supplied from the discharge end of said second conveyor; and a controller of the first and second linear speeds in relation to the measured rate of processing.

14. A flat article delivering apparatus as recited in claim 13, wherein the processing rate detector comprises an encoder of a speed of rotation of a rotative member of the downstream article-processing equipment.

15. A flat article delivering apparatus as recited in claim 13, further comprising article-detecting proximity sensors mounted at said discharge end of the second conveyor and connected to the controller, wherein the controller controls the first and second linear speeds also in relation to signals from the article-detecting proximity sensors.

16. A flat article delivering apparatus as recited in claim 13, further comprising means for entering a thickness of the generally flat articles in the controller, wherein the controller controls the first and second linear speeds also in relation to the input article thickness.

* * * * *